US009169818B2

(12) United States Patent
Baeuerle et al.

(10) Patent No.: US 9,169,818 B2
(45) Date of Patent: Oct. 27, 2015

(54) INTERNAL COMBUSTION ENGINE

(75) Inventors: Michael Baeuerle, Eberdingen (DE); Alexander Schenck Zu Schweinsberg, Moeglingen (DE); Klaus Ries-Mueller, Bad Rappenau (DE)

(73) Assignee: ROBERT BOSCH GMBH, Stuttgart (DE)

( * ) Notice: Subject to any disclaimer, the term of this patent is extended or adjusted under 35 U.S.C. 154(b) by 802 days.

(21) Appl. No.: 13/132,020

(22) PCT Filed: Nov. 24, 2009

(86) PCT No.: PCT/EP2009/065708

§ 371 (c)(1),
(2), (4) Date: Aug. 10, 2011

(87) PCT Pub. No.: WO2010/063615

PCT Pub. Date: Jun. 10, 2010

(65) Prior Publication Data

US 2011/0283974 A1 Nov. 24, 2011

(30) Foreign Application Priority Data

Dec. 1, 2008 (DE) ..... 10 2008 044 244

(51) Int. Cl.
*F02B 3/00* (2006.01)
*F02M 69/04* (2006.01)

(52) U.S. Cl.
CPC ..... *F02M 69/043* (2013.01); *F02M 69/044* (2013.01)

(58) Field of Classification Search
CPC . F02D 41/402; F02D 41/403; F02D 41/3094; F02D 41/36
USPC ..... 123/297, 299–305, 429–432
See application file for complete search history.

(56) References Cited

U.S. PATENT DOCUMENTS

| | | | | |
|---|---|---|---|---|
| 4,315,491 | A | 2/1982 | Takeda | |
| 4,549,511 | A * | 10/1985 | Grieshaber et al. | 123/263 |
| 4,964,381 | A | 10/1990 | Shiozaki et al. | |
| 5,027,778 | A * | 7/1991 | Nogi et al. | 123/472 |
| 5,413,078 | A | 5/1995 | Mitsunaga et al. | |

(Continued)

FOREIGN PATENT DOCUMENTS

| | | |
|---|---|---|
| CN | 1965160 | 5/2007 |
| DE | 10 2006 056 574 | 5/2007 |

(Continued)

OTHER PUBLICATIONS

International Search Report for PCT/EP2009/065708, dated Mar. 1, 2010.

*Primary Examiner* — John Kwon
(74) *Attorney, Agent, or Firm* — Kenyon & Kenyon LLP

(57) ABSTRACT

An internal combustion engine has at least one combustion chamber which may be closed by an intake valve, at least one air intake port which leads to the intake valve, and a fuel injection device which in association with the at least one combustion chamber has a first injector and a second injector for the metered injection of fuel into at least one intake port. To achieve significantly improved mixture preparation and combustion of the fuel-air mixture in the combustion chamber, the two injectors are configured such that the first injector injects a widely divergent spray cone having a large cone angle, and the second injector injects an only slightly divergent spray cone having a much smaller cone angle.

8 Claims, 3 Drawing Sheets

(56) References Cited

U.S. PATENT DOCUMENTS

| | | | | |
|---|---|---|---|---|
| 5,553,579 | A * | 9/1996 | Yoshida et al. | 123/295 |
| 5,806,473 | A * | 9/1998 | Kometani et al. | 123/73 C |
| 6,295,972 | B1 * | 10/2001 | Radue | 123/499 |
| 7,584,740 | B2 * | 9/2009 | Boyarski | 123/304 |
| 7,721,710 | B2 * | 5/2010 | Leone et al. | 123/431 |
| 2006/0201152 | A1 | 9/2006 | Irisawa | |

FOREIGN PATENT DOCUMENTS

| | | |
|---|---|---|
| EP | 0 337 763 | 10/1989 |
| EP | 1 260 695 | 11/2002 |
| JP | 2524859 | 11/1996 |
| JP | 1 0-1 96494 | 7/1998 |
| JP | 10196440 | 7/1998 |
| JP | 2002-317738 | 10/2002 |
| JP | 2003-262174 | 9/2003 |
| JP | 2003-262175 | 9/2003 |
| JP | 2006-207527 | 8/2006 |
| JP | 3885614 | 2/2007 |
| JP | 2007-170377 | 7/2007 |
| JP | 2007170377 | 7/2007 |
| JP | 2007-292058 | 11/2007 |
| JP | 4016675 | 12/2007 |
| WO | WO 01/79690 | 10/2001 |

* cited by examiner

INTERNAL COMBUSTION ENGINE

FIELD OF THE INVENTION

The present invention is directed to an internal combustion engine.

BACKGROUND INFORMATION

In one known fuel injection device for an internal combustion engine (JP-10196440 A), the first injector and second injector each inject into the intake port of the internal combustion engine, the first injector injecting upstream from a throttle valve inserted into the intake port for air flow regulation, and the second injector injecting downstream from the throttle valve, the injection by the second injector occurring prior to the injection by the first injector.

SUMMARY

The internal combustion engine according to an example embodiment of the present invention having the features described herein has the advantage that fuel may be supplied in the direction of the intake valve in different ways, using the two differently configured injectors which inject into the intake port of the at least one combustion cylinder, resulting in greatly improved mixture preparation and combustion in various operating ranges of the internal combustion engine. Thus, for a warm internal combustion engine under high load, it is advantageous to inject the fuel with a high degree of penetration, with the intake valve open, directly into the combustion chamber, while for a cold internal combustion engine a high degree of wetting of the wall region of the intake port immediately upstream from the intake valve results in improved combustion, since the wall film only arrives in the combustion chamber in a time-delayed manner. Using the differing configurations for the two injectors, this operating point-dependent optimization of the combustion may be easily achieved in various operating ranges of the internal combustion engine by controlling the two injectors in different manners. Thus, by using the two injectors in different manners, the lambda distribution in the combustion chamber may be optimized in various operating ranges, a localized overly rich air-fuel ratio associated with high hydrocarbon (HC) concentrations as well as a localized overly lean air-fuel ratio which promotes "knocking" of the internal combustion engine may be avoided, and fuel consumption may be reduced. Thus, in cold start mode, for example, the mixture preparation may be improved and the HC emissions reduced by using the first injector, on account of the smaller fuel droplets in its spray cone. Under full load, as the result of increased use of the second injector, together with the greater penetration all the way to the combustion chamber and minimized wall film generation in the intake port, the heat of evaporation of the fuel is removed more intensely from the cylinder charge than from the wall of the intake port, thus providing greater cooling of the cylinder charge and reducing the sensitivity to knocking.

For supercharged internal combustion engines it is possible to make use of so-called scavenging without an injector which injects directly into the combustion chamber, since with regard to the small cone angle of its spray cone the second injector generates little or no wall film in the intake port. Thus, little or no fuel passes into the combustion chamber in the direction of the catalytic converter when the combustion chamber is purged with air (scavenging). Scavenging may be achieved with a tolerable load for the catalytic converter, and in conjunction with turbocharging results in a considerable torque gain at low rotational speeds.

When the engine is coasting, the wall film in the intake port may be minimized by using the second injector, so that pollution emissions are reduced when the internal combustion engine is restarted, in particular during stop-and-go driving.

Using the various features described herein of the injectors and/or the intake valves for a combustion chamber having two intake valves, each of which closes off an inlet, and as a result of the particular association of intake valve and injector in conjunction with separate control of the injectors, the above-described effects of reducing the tendency toward knocking, optimizing the combustion mixture while avoiding a localized overly rich air-fuel ratio and a localized overly lean air-fuel ratio, and reduced fuel consumption may be incrementally improved.

According to example embodiments of the present invention, the injectors are electrically controllable solenoid valves. Such solenoid valves are much less expensive than frequently used piezoelectric injectors.

Example embodiments of the present invention are explained in greater detail below with reference to the Figures.

DETAILED DESCRIPTION

Figure 1:
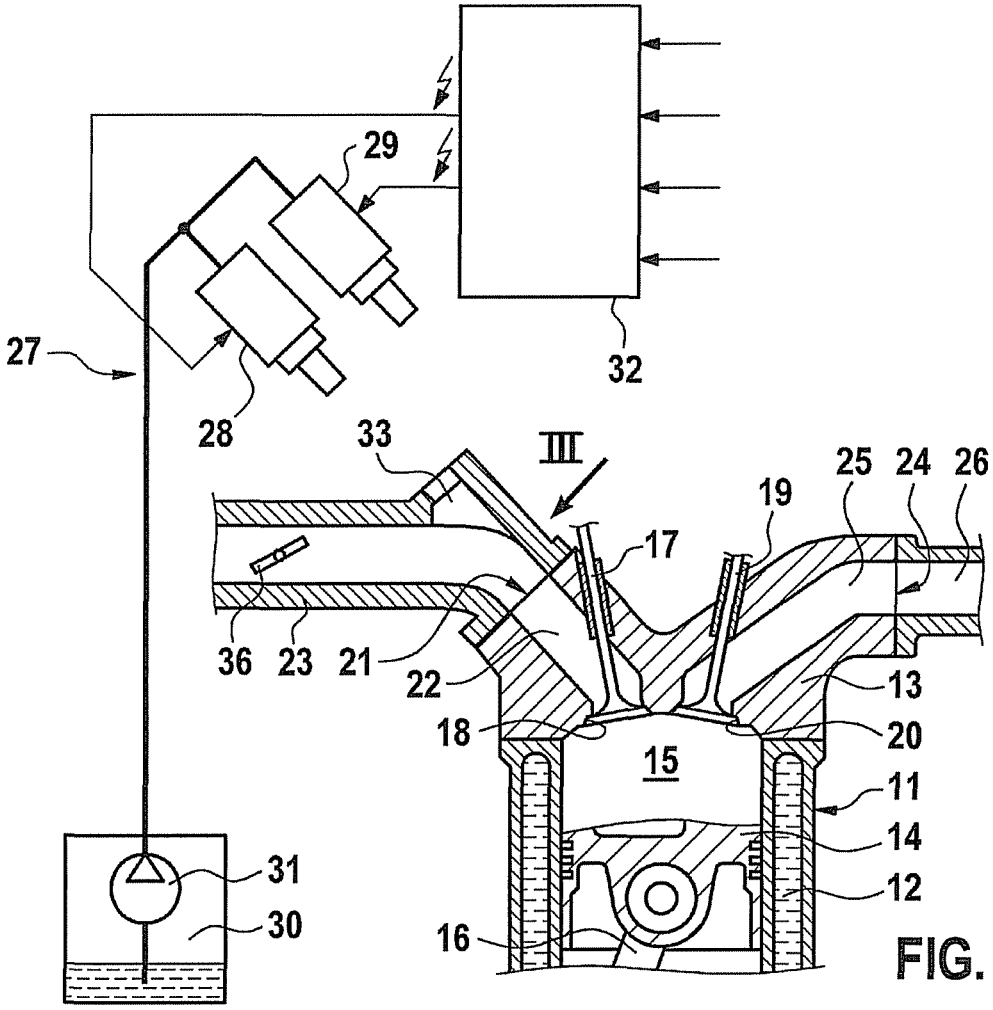
FIG. 1 shows a detail of a longitudinal section of a combustion cylinder of an internal combustion engine in conjunction with a fuel injection device.

Of a typically multicylinder internal combustion engine for motor vehicles, for example, only one combustion cylinder 11, shown in a detail in a longitudinal section, is schematically illustrated in FIG. 1. Combustion cylinder 11, which is surrounded on the outside by a cooling water jacket 12, is covered on the end face by a cylinder head 13 in a gas-tight manner. A reciprocating piston 14 which is guided in combustion cylinder 11 in an axially displaceable manner, together with cylinder head 13, delimits a combustion chamber 15. Reciprocating piston 14 is connected via a connecting rod 16 to a crankshaft (not illustrated here), upon which the reciprocating pistons of the other combustion cylinders also act.

Figure 4:
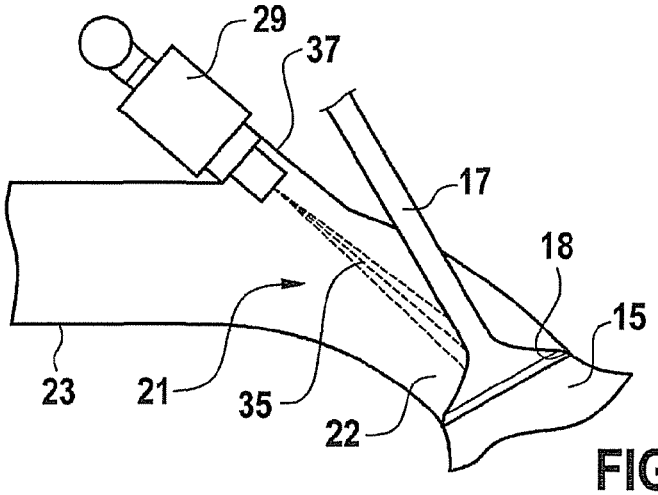
FIG. 4 shows a section along line IV-IV in FIG. 3.
Figure 3:
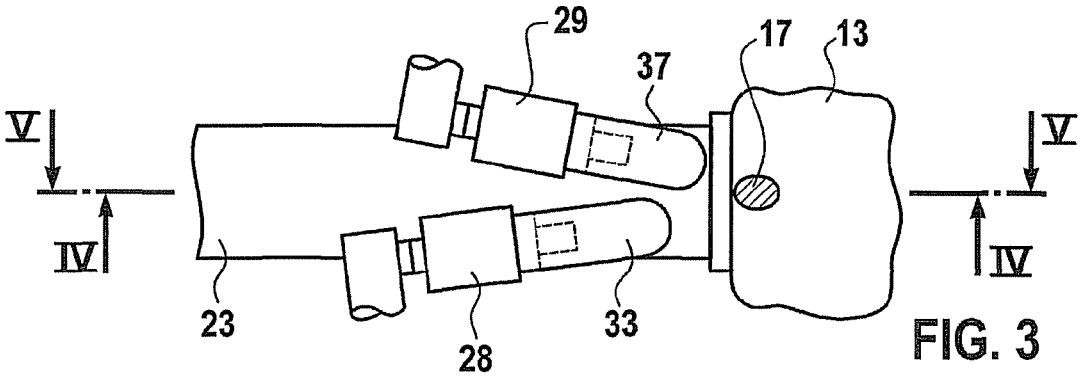
FIG. 3 shows a detail of a top view in the direction of arrow III in FIG. 2 for injectors inserted into an intake port of the internal combustion engine.
Figure 5:
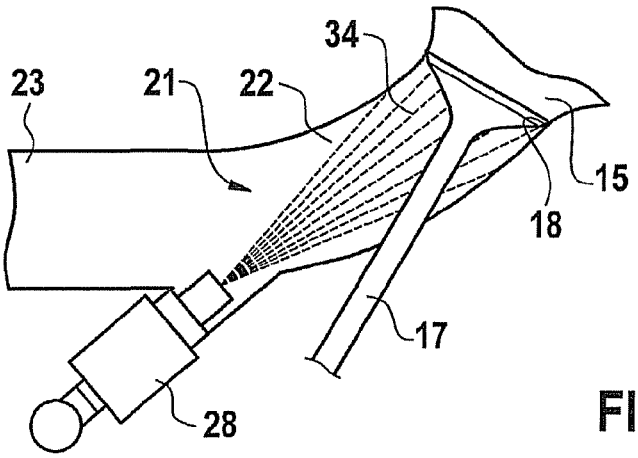
FIG. 5 shows a section along line V-V in FIG. 3.

In a first exemplary embodiment illustrated in FIGS. 3 through 5 in conjunction with FIG. 1, combustion chamber 15 has an inlet 18 which may be closed by an intake valve 17, and an outlet 20 which may be closed by an exhaust valve 19. An intake port 21 for combustion air, composed of an inlet channel 22 provided in cylinder head 13 and an intake manifold 23 attached to inlet channel 22, leads to inlet 18. Upstream therefrom, intake manifolds 23 of multiple combustion cylinders 11 are usually combined into an air intake fitting, using an intake manifold elbow, in which an air flow control element, preferably a throttle valve, is provided for regulating the air flow. Strictly for purposes of clarification, FIG. 1 shows throttle valve 36 in intake manifold 23 of the one combustion cylinder 11. Leading away from outlet 20 is an exhaust port 24 composed of an outlet channel 25 provided in cylinder head 13, and an exhaust pipe 26 attached to outlet channel 25. Exhaust pipes 26 of multiple combustion cylinders 11 are combined downstream via an exhaust manifold.

For supplying fuel to combustion chamber 15 of the at least one combustion cylinder 11, a fuel injection device 27 is provided which has two electromagnetic injectors 28, 29 for each combustion cylinder 11, i.e., each combustion chamber 15. The two injectors 28, 29 are supplied with fuel by a fuel pump 31 which conveys fuel from a fuel tank 30, and are controlled by an electronic control unit 32 which is provided with a plurality of parameters which specifies the operating points of the internal combustion engine. Upstream from throttle valve 36, the two injectors 28, 29 are inserted into insertion openings 33, 37 (FIGS. 3 through 5) provided in intake port 21, in this case in intake manifold 23, such that they allow fuel to be injected into intake port 21, the fuel being injected from injectors 28, 29 in atomized form in the shape of spray cones. The two injectors 28, 29, which are situated as close as possible to intake valve 17, are aligned such that their spray cones are directed toward intake valve 17. The two injectors 28, 29 have different configurations with respect to the fuel throughput as well as the configuration of the injected fuel spray cone. First injector 28 injects a widely divergent spray cone 34 (FIG. 5) having a large cone angle, and second injector 29 injects an only slightly divergent spray cone 35 (FIG. 4) having a much smaller cone angle. Spray cone 35 of second injector 29 has much greater penetration, and when intake valve 17 is open is therefore able to penetrate much more deeply into combustion chamber 15 than is spray cone 34 of first injector 28, which has a much smaller degree of penetration. Second injector 29 is also designed for a much higher fuel throughput compared to first injector 28, and is able to inject, for example, at least 70% of the full load quantity. In the exemplary embodiment illustrated, insertion opening 33 for first injector 28 is situated slightly farther from inlet 18 than is insertion opening 37 for second injector 29, so that the injection opening of first injector 28 is slightly farther from intake valve 17 than is the injection opening of second injector 29. A configuration in which the two insertion openings 33, 37 are equidistant from inlet 18 is also possible.

Figure 7:
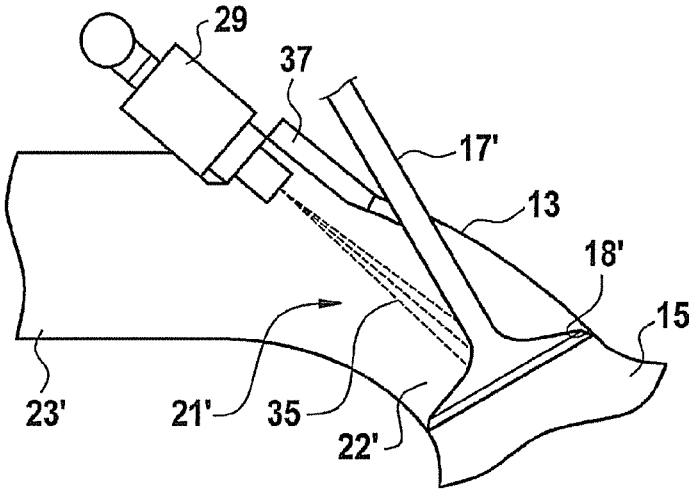
FIG. 7 shows a section along line VII-VII in FIG. 6.
Figure 6:
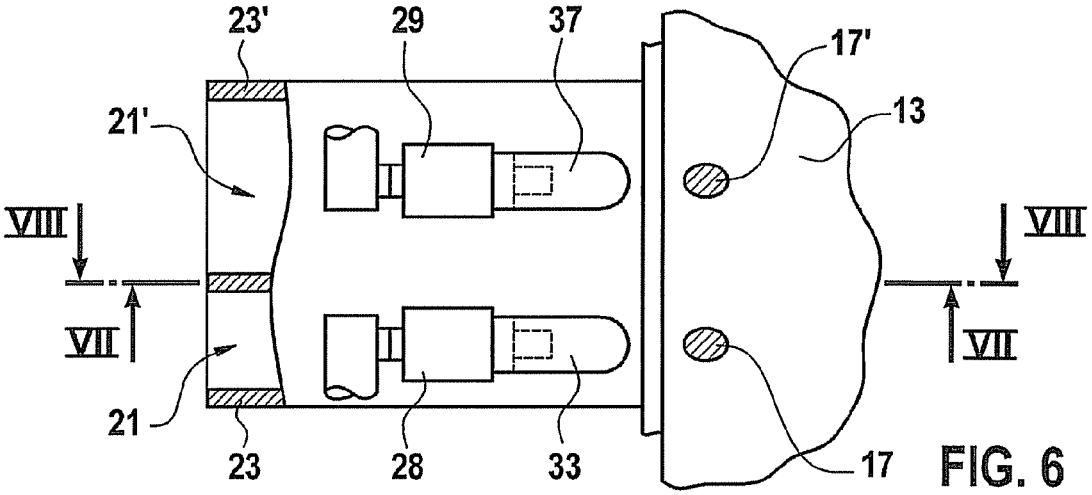
FIG. 6 shows a representation, similar to FIG. 3, of another exemplary embodiment of a combustion cylinder.
Figure 8:
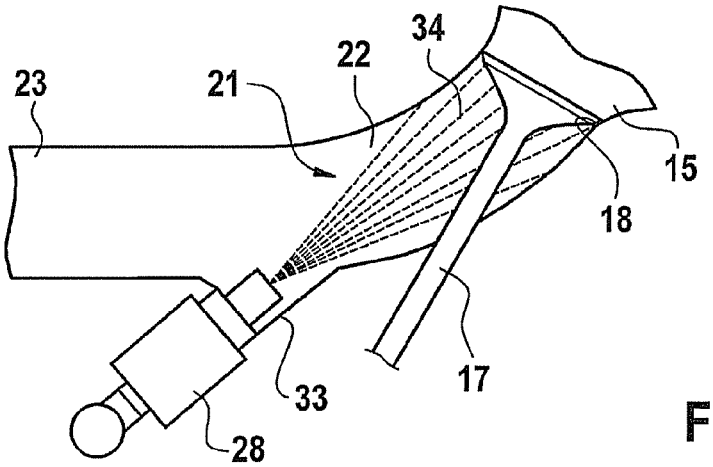
FIG. 8 shows a section along line VIII-VIII in FIG. 6.

In another exemplary embodiment of combustion cylinder 12 of an internal combustion engine according to FIG. 1 illustrated in FIGS. 6 through 8, combustion chamber 15 having cylinder head 13 is modified such that two inlets 18, 18' are present, each of which may be closed by an intake valve 17, 17', respectively. A first intake port 21 for combustion air leads to first inlet 18 (FIG. 7), and a second intake port 21' for combustion air leads to second inlet 18' (FIG. 8). Intake ports 21, 21' are each composed of an inlet channel 22, 22', respectively, provided in cylinder head 13 and an intake manifold 23, 23' attached to inlet channel 22, 22', respectively. Fuel is supplied to combustion chamber 15 in the same manner as described above in conjunction with FIG. 1. First injector 28 is inserted in the same manner into an insertion opening 33 provided in first intake port 21, in this case once again in intake manifold 23, close to intake valve 17 in order to inject fuel into first intake port 21. Second injector 29 is inserted in the same way into an insertion opening 37 provided in second intake port 21', in this case once again in intake manifold 23', close to second intake valve 17' in order to inject fuel into second intake port 21'. Both injectors 28, 29 have the same configuration as described above, and once again are aligned such that their spray cones 34, 35 are directed toward associated intake valves 17, 17', respectively. As is apparent from FIGS. 6 through 8, the opening cross sections of the two inlets 18, 18' in combustion chamber 15 of combustion cylinder 11 have different sizes. First injector 28 is associated with first intake port 21 leading to first inlet 18 having a smaller cross section, while second injector 29 injects into second intake port 21' leading to second inlet 18' having a larger cross section. The cross sections of the two intake ports 21, 21', or, stated more precisely, the cross sections of inlet channels 22, 22' in cylinder head 13, may be the same size, or, as illustrated in FIGS. 6 through 8, may also be of different sizes, first intake port 21 into which first injector 28 injects having the smaller diameter.

In another modification of the exemplary embodiment according to FIGS. 6 through 8, the two intake valves 17, 17' may have valve strokes of different sizes. The two injectors 28, 29 are then associated with intake valves 17, 17', respectively, such that first injector 28 is associated with intake valve 17 having the smaller valve stroke, and second injector 29 is associated with intake valve 17' having the larger valve stroke.

In another example embodiment, one of intake valves 17, 17' is provided with a valve mask, and first injector 28 injects into the intake port which leads to the intake valve having the valve mask.

In the same manner as illustrated in the exemplary embodiment according to FIGS. 3 through 5, in the exemplary embodiment illustrated in FIGS. 6 through 8 the two injectors 28, 29 may also be situated at different distances from associated intake valve 17, 17' in intake port 21, 21', respectively. The distance of first injector 28 from first intake valve 17 is preferably slightly larger than the distance of second injector 29 from second intake valve 17'.

Figure 2:
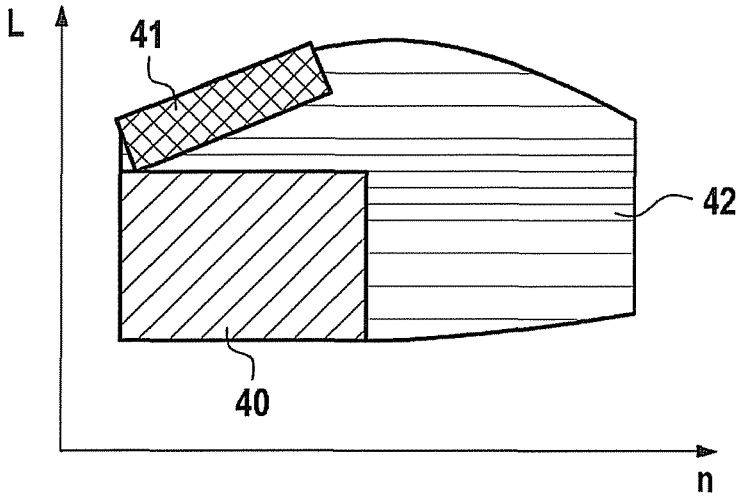
FIG. 2 shows a diagram for control ranges of the injectors of the fuel injection device in FIG. 1, in association with operating points of the internal combustion engine specified by rotational speed (n) and load (L)

In all of the described exemplary embodiments, the two injectors 28, 29 for each combustion cylinder 11 are controlled differently by electronic control unit 32 as a function of the operating points of the internal combustion engine. For this purpose a diagram is stored in control unit 32, as schematically illustrated in FIG. 2. At a certain operating point of the internal combustion engine which is specified by rotational speed n and load L required by the internal combustion engine, one or the other of the two injectors 28, 29 or both injectors 28, 29 is/are activated. The hatched region in the diagram denoted by reference numeral 40 indicates the range of small partial load, in which only first injector 28 is used for introducing fuel into combustion chamber 15. The cross-hatched region denoted by reference numeral 41 is used for scavenging, in which only second injector 29, having a small spray cone 35 and a high degree of penetration, is activated, and which generates no appreciable wall film upstream from inlet 18 of combustion chamber 15. In the remaining region denoted by reference numeral 42, both injectors 28, 29 are activated for fuel injection.

To improve the mixture preparation and tumble motion in the various operating points, the two intake valves 17, 17' for each combustion chamber 15 have time-delayed opening phases. Injectors 28, 29 are then associated with intake valves 17, 17' such that first intake valve 28 is situated in intake port 21, leading to intake valve 17 which opens earlier, and second injector 29 is situated in intake valve 17' which opens later. In a certain operating mode of the internal combustion engine, first injector 17 may then be activated by control electronics system 32 such that the first injector injects fuel only at a point in time at which second intake valve 17' opens, thus reliably preventing overlap of open inlet 13, 13' and outlet 20 of combustion chamber 15.

What is claimed is:

1. An internal combustion engine, comprising:

at least one combustion chamber;

first and second inlets having respective first and second upstream intake ports and being closable by respective first and second intake valves, and adapted to draw in combustion air; and a fuel injection device in association with the at least one combustion chamber having a first injector and a second injector adapted for metered injection of fuel into a respective one of the first and second intake ports, the injectors adapted to inject the fuel in atomized form in the shape of spray cones, the first injector adapted to inject a first divergent spray cone having a first cone angle, the second injector adapted to inject a second divergent spray cone having a second cone angle that is smaller than the first cone angle, wherein:

opening cross-sections of the first and second inlets to the combustion chamber are of different sizes, the cross section of the first inlet being smaller than the cross section of the second inlet, the first injector is associated with the first intake port leading to the first inlet having the smaller cross-section, the second injector is associated with the second intake port leading to the second inlet having the larger cross-section, the first and second intake ports lead to the first and second intake valves having diameters of different sizes, the first intake port having a smaller diameter than the second intake port, the first injector is assigned to the first intake port having the smaller diameter, and the second injector is assigned to the second intake port having the larger diameter, and wherein the two intake valves have time-delayed opening phases, and a first injector is associated with the intake port leading to the intake valve which opens first, and a second injector is associated with the intake port leading to the intake valve which opens later.

2. The internal combustion engine according to claim 1, wherein the second injector has a greater injection range compared to the first injector.

3. The internal combustion engine according to claim 1, wherein the second injector is adapted for a higher fuel throughput compared to the first injector.

4. The internal combustion engine according to claim 3, wherein the ratio of the fuel throughput of the second injector to that of the first injector is approximately 7:3.

5. The internal combustion engine according to claim 1, wherein the two intake valves have valve strokes of different sizes, and a first injector is adapted to inject into the intake port leading to the intake valve having a smaller valve stroke, and a second injector is adapted to inject into the intake port leading to the intake valve having a larger valve stroke.

6. The internal combustion engine according to claim 1, wherein the first injector is activated for injection only when the intake valve which opens later is open.

7. The internal combustion engine according to claim 1, wherein a first injector is situated at a farther distance from the associated intake valve compared to a second injector.

8. The internal combustion engine according to claim 1, wherein each of the first intake port and the second intake port includes an inlet channel, which is provided in a cylinder head of a combustion cylinder which delimits the combustion chamber and an intake manifold attached thereto, and the injectors are inserted into the intake manifold such that the fuel is injected through the associated inlet channel and to the associated intake valve.

* * * * *